US007338189B2

(12) United States Patent
Kovacik et al.

(10) Patent No.: US 7,338,189 B2
(45) **Date of Patent: *Mar. 4, 2008**

(54) LED UTILITY LIGHT WITH REMOVABLE MAGNET

(75) Inventors: James D. Kovacik, Brecksville, OH (US); Paul S. Blanch, Broadview Heights, OH (US); Joseph J. Smith, Wooster, OH (US)

(73) Assignee: Alert Safety Lite Products Co., Inc., Bedford Heights, OH (US)

( * ) Notice: Subject to any disclaimer, the term of this patent is extended or adjusted under 35 U.S.C. 154(b) by 156 days.

This patent is subject to a terminal disclaimer.

(21) Appl. No.: 11/200,934

(22) Filed: Aug. 10, 2005

(65) Prior Publication Data

US 2006/0034091 A1 Feb. 16, 2006

Related U.S. Application Data

(63) Continuation-in-part of application No. 29/234,468, filed on Jul. 19, 2005, now Pat. No. Des. 528,240, and a continuation-in-part of application No. 10/915,527, filed on Aug. 10, 2004, now Pat. No. 7,150,540, and a continuation-in-part of application No. 10/914,805, filed on Aug. 10, 2004, now Pat. No. 7,175,303.

(51) Int. Cl.
*F21V 21/00* (2006.01)

(52) U.S. Cl. ..... 362/398; 362/249; 362/196; 362/240; 362/800

(58) Field of Classification Search ..... 362/398, 362/190, 191, 102, 183, 184, 249–252, 800, 362/368, 370, 371, 390, 200, 376, 196, 362, 362/240; 248/206.5; 439/38–40
See application file for complete search history.

(56) References Cited

U.S. PATENT DOCUMENTS 1,977,086 A * 10/1934 Pryor ..... 362/208

(Continued)

FOREIGN PATENT DOCUMENTS

DE 198 02 998 8/1998

(Continued)

*Primary Examiner*—Sandra O'Shea
*Assistant Examiner*—Gunyoung T. Lee
(74) *Attorney, Agent, or Firm*—Fraser Clemens Martin & Miller LLC; William J. Clemens

(57) ABSTRACT

An LED utility light includes a hollow housing having a wider upper light portion connected to a narrower lower handle portion. The light portion has a lens opening covered by a lens permitting light generated from an array of LEDs to exit the housing. A magnet mounted on the housing releasably retains the utility light on a support surface. The magnet is releasably attached to the housing and can be rotated about an axis generally parallel to the longitudinal axis of the housing.

20 Claims, 7 Drawing Sheets

U.S. PATENT DOCUMENTS

| | | | | | |
|---|---|---|---|---|---|
| 4,019,047 | A * | 4/1977 | Frey | 362/257 |
| 4,907,769 | A * | 3/1990 | Hunley et al. | 248/185.1 |
| 5,165,782 | A * | 11/1992 | Maglica et al. | 362/208 |
| 5,188,450 | A * | 2/1993 | Anderson | 362/194 |
| 5,577,697 | A * | 11/1996 | Accordino | 248/206.5 |
| 5,797,672 | A * | 8/1998 | Dobert | 362/190 |
| 5,806,961 | A * | 9/1998 | Dalton et al. | 362/183 |
| 6,485,160 | B1 * | 11/2002 | Sommers et al. | 362/184 |
| 6,511,203 | B1 * | 1/2003 | Winther | 362/202 |
| 6,669,353 | B2 * | 12/2003 | Kung | 362/191 |
| 6,979,104 | B2 * | 12/2005 | Brass et al. | 362/231 |
| 7,059,743 | B2 * | 6/2006 | Niemann | 362/184 |
| 2003/0039121 | A1 | 2/2003 | Nezigane | |

FOREIGN PATENT DOCUMENTS

| | | |
|---|---|---|
| DE | 203 17 017 | 3/2004 |
| WO | WO 02/03761 | 1/2002 |

* cited by examiner

LED UTILITY LIGHT WITH REMOVABLE MAGNET

CROSS-REFERENCE TO RELATED APPLICATIONS

This application is a continuation-in-part of each of the U.S. patent application Ser. No. 10/914,805 filed Aug. 10, 2004, now U.S. Pat. No. 7,175,303, the U.S. patent application Ser. No. 10/915,527 filed Aug. 10, 2004, now U.S. Pat. No. 7,150,540, and the U.S. patent application Ser. No. 29/234,468 filed Jul. 19, 2005, now U.S. Pat. No. D.528,240.

BACKGROUND OF THE INVENTION

The present invention relates generally to illumination devices and, in particular, to a utility light having a light source configured as an array of LEDs and a magnet for releasably attaching the utility light to surfaces.

Portable lights, which can be manually moved and suspended about a work site to aid a user to obtain the best lighting conditions, are well known. It has been the practice to use incandescent light bulbs, suitably encased in fight guards, for this purpose. Such lights are often referred to as trouble lamps, extension lights, work lights, inspection fights, utility lights, and the like, and are commonly employed by mechanics and other workers who require a concentration of light while frequently changing locations. Such a trouble light is shown in the U.S. Pat. No. 4,774,647 to Kovacik et al. Fluorescent lights have several advantages in use as compared with the incandescent bulbs. As an example, for the same wattage fluorescent lights usually provide more light with less glare. In the past, attempts have been made to convert portable lights such as extension lights to fluorescent tubes. For example, see the U.S. Pat. No. 5,921,658 to Kovacik et al.

Light emitting diodes (LEDs) are well known for providing illumination to digital displays and the like. It has become more common for an array of LEDs to be utilized for providing illumination. LEDs are particularly advantageous because of their low power consumption per candlepower produced when compared to incandescent light bulbs and, to a lesser degree, to fluorescent fight bulbs.

It is desirable to provide a portable light having lower power consumption that also provides sufficient illumination for a work site. It is also desirable to be able to place and orient the portable light in as many locations and positions as possible. It further is desirable to provide utility lamps that are lightweight and cost-effective to produce.

SUMMARY OF THE INVENTION

The present invention concerns an LED utility light including: a hollow housing having a wider upper light portion connected to a narrower lower handle portion, the light portion having a lens opening formed therein; a plurality of LEDs mounted in the housing adjacent the lens opening; a transparent lens member mounted in the lens opening permitting light generated from the LEDs to exit the housing; and a magnet assembly mounted on the housing and adapted to releasably retain the utility light on a support surface. A magnet of the magnet assembly is releasably attached to the housing and can be rotated about an axis generally parallel to the longitudinal axis of the housing. The narrower handle portion allows for easier manipulation of the utility light by a single human hand when in use.

The LEDs are mounted on a circuit board in rows and columns. A reflector has a reflective surface facing the lens and apertures for each of the LEDs. A hook member is disposed in a recess formed in an exterior surface of the housing and is rotatable between a stored position in the recess and an extended position. The hook member is attached to the housing by a ball and socket connection permitting the hook member to rotate about a longitudinal axis of the hook member. An electrical plug is disposed in the rear housing half at a preferably canted position with respect to the longitudinal axis of the rear housing half in a receiver portion formed in the rear housing half.

The LED utility light in accordance with the present invention advantageously provides a portable handheld utility light that may be placed and oriented in many locations and positions with the use of the hook member and the removable magnet assembly.

DESCRIPTION OF THE DRAWINGS

The above, as well as other advantages of the present invention will become readily apparent to those skilled in the art from the following detailed description of a preferred embodiment when considered in the light of the accompanying drawings in which.

DESCRIPTION OF THE PREFERRED EMBODIMENT

Figure 1:
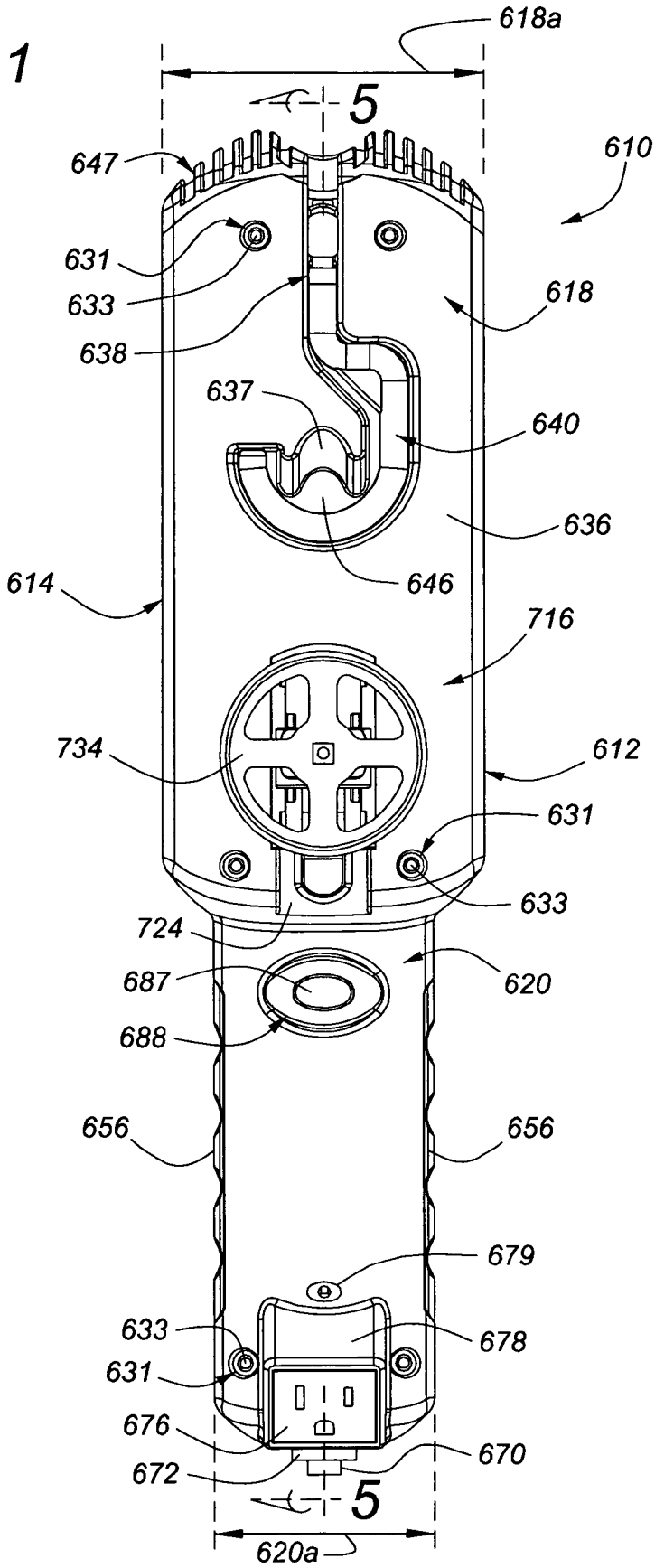
FIG. 1 is a rear elevation view of an LED utility light in accordance with the present invention.

The following patent applications are incorporated herein by reference: U.S. patent application Ser. No. 10/914,805 filed Aug. 10, 2004; U.S. patent application Ser. No. 10/915,527 filed Aug. 10, 2004; and U.S. patent application Ser. No. 29/234,468 filed Jul. 19, 2005.

Referring now to FIGS. 1-4, an LED utility light in accordance with the present invention is indicated generally at 610. The utility light 610 includes a hollow light housing 612 split on a vertical plane into a rear housing portion 614 and a front housing portion 616. When attached, the housing portions 614 and 616 define an elongated upper light portion 618, having a first width indicated by an arrow 618*a*, extending from a lower handle portion 620, having a second width indicated by an arrow 620*a* that is less than the first width. The housing portions 614 and 616 are substantially arcuate in cross section and, when attached, form the housing 612 with a substantially oval cross section, best seen in FIG. 6. The housing 612 is preferably formed of a lightweight material, such as plastic or the like, as the utility fight 610 is contemplated to be both handheld and portable. The rear housing portion 614 includes a plurality of transverse strengthening ribs 622 (FIG. 3) extending generally horizontally across interior walls thereof A plurality of tubular bosses 624 each having a larger diameter base 626 and a smaller diameter free end 628 extend from an inner surface 630 of the rear housing portion 614 for receiving respective fasteners 633 (FIG. 1) inserted into corresponding apertures 631 formed in the housing portion 614. The fasteners 633 extend through the bosses 624 and threadably engage corresponding posts 632 (FIG. 4) formed in and extending inwardly from an inner surface 617 of the front housing portion 616 to secure the housing portions 614 and 616 together to form the housing 612, discussed in more detail below. The front housing portion 616 includes a plurality of transverse strengthening ribs 623 extending across the inner wall thereof During assembly, the smaller diameter free end 628 of each of the bosses 624 is received by a corresponding aperture 634 formed in an associated one of the posts 632 of the front housing portion 616.

An exterior surface 636 of the rear housing portion 614 is formed to define a hook recess 638 for receiving and storing a hook member 640 therein. The hook member 640 includes a ball portion 642 that is connected to a shank portion 644. The recess 638 has a respective closed bottom wall 646 at the inner surface 630 the rear housing portion 614, best seen in FIG. 2. The wall 646 does not extend above the ribs 622 in the rear housing portion 614. The shape of the recess 638 corresponds to the shape of the hook member 640 in plan view. When the hook member 640 is disposed in the recess 638, the hook member 640 does not extend above the exterior surface 636 of the rear housing portion 614. Formed in a side wall of the recess 638 is a sloped surface 637 that provides access to the hook member 640 by a human finger for improved removal and stowage of the hook member 640.

Figure 2:
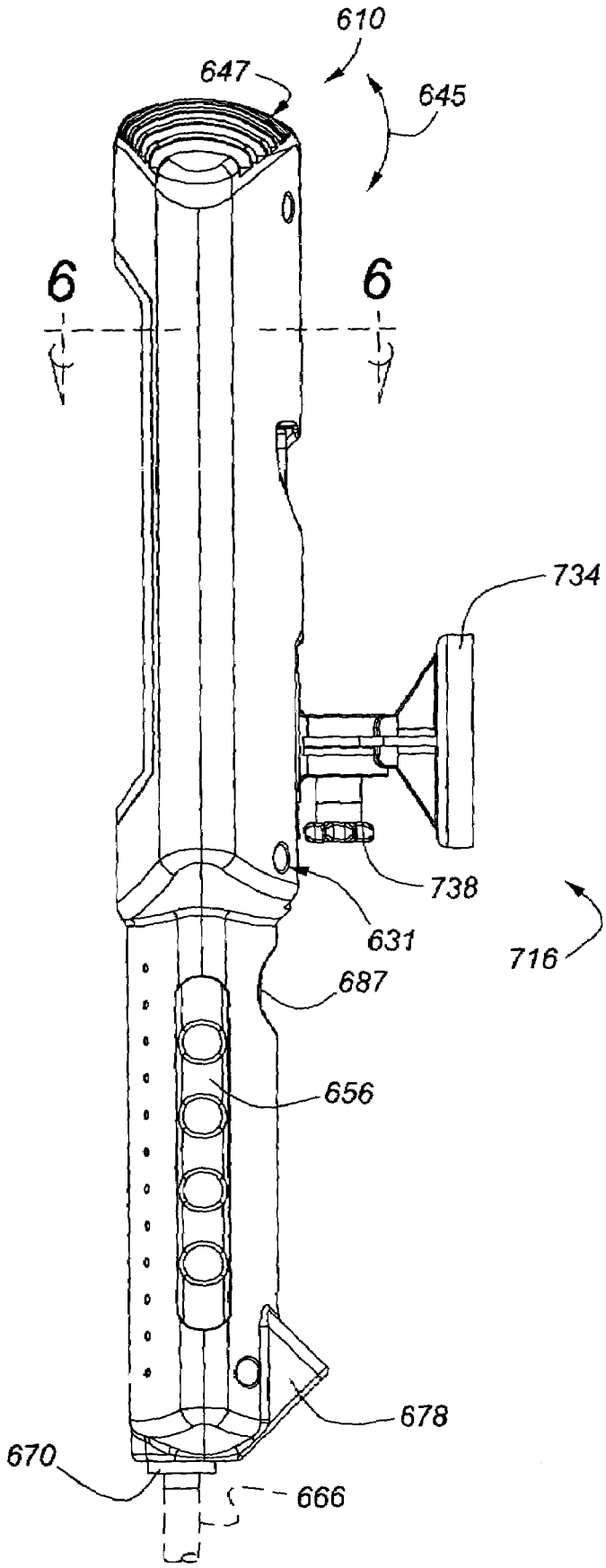
FIG. 2 is a side elevation view of the utility light of FIG. 1.

The ball portion 642 of the hook member 640 cooperates with a ball retainer 643 disposed between the rear housing portion 614 and the front housing portion 616 when the housing 612 is assembled. The ball retainer 643 includes a pair of retaining arms 643*a* extending from opposing sides of a cup shaped ball receiver. Each of the retaining arms 643*a* is apertured to receive an associated one of the free ends 628 of the mating bosses 624. The ball receiver 643 cooperates with a pair of curved surfaces formed on the inside of the rear housing portion 614 to retain the ball portion 642 of the hook member 640. The ball receiver 643, the surfaces and the ball portion 640 function as ball and socket attachments for the hook member 640. As shown in FIG. 2, the hook member 640 can rotate between the stored position shown and an extended "use" position as indicated by an arrow 645. Once out of the recess 38, the hook member 640 is free to rotate about its respective longitudinal axis. The hook member 640, therefore, provides a means for placing and orienting the utility light 610 during use.

An upper cushion 647 is formed of a resilient material and is contoured to the shape of an upper end of the light housing 612. A plurality of attachment fingers 648 extend from a lower surface of the cushion 647 and have a wider stop portion 650 at a free end of a narrower shaft portion 652. The upper cushion 646 is attached to the top of the light portion 618 of the housing 612 by placing the shaft portion 652 of each of the attachment fingers 648 in a corresponding one of a plurality of grooves or cutouts 654 formed in the upper walls of the rear portion 614 and the front portion 616 of the housing 612. The stop portions 650 prevent removal of the cushion 646 from the housing 612 after the housing has been assembled, as discussed in more detail below. Similarly, each one of a pair of elongated handle cushions 656 includes a plurality of attachment fingers 658 having a larger stop portion 660 and a smaller diameter shaft portion 662. The handle cushions 656 are each attached to the handle portion 620 of the housing 612 by placing the shaft portions 662 of the attachment fingers 658 in corresponding ones of a plurality of grooves or cutouts 664 formed in facing edges of the rear portion 614 and the front portion 616 of the housing 612. The stop portions 660 prevent removal of the cushions 656 from the housing 612 after the housing 612 has been assembled. The upper cushion 646 and the handle cushions 656 are each preferably constructed of a soft, easily deflectable resilient material.

Figure 3:
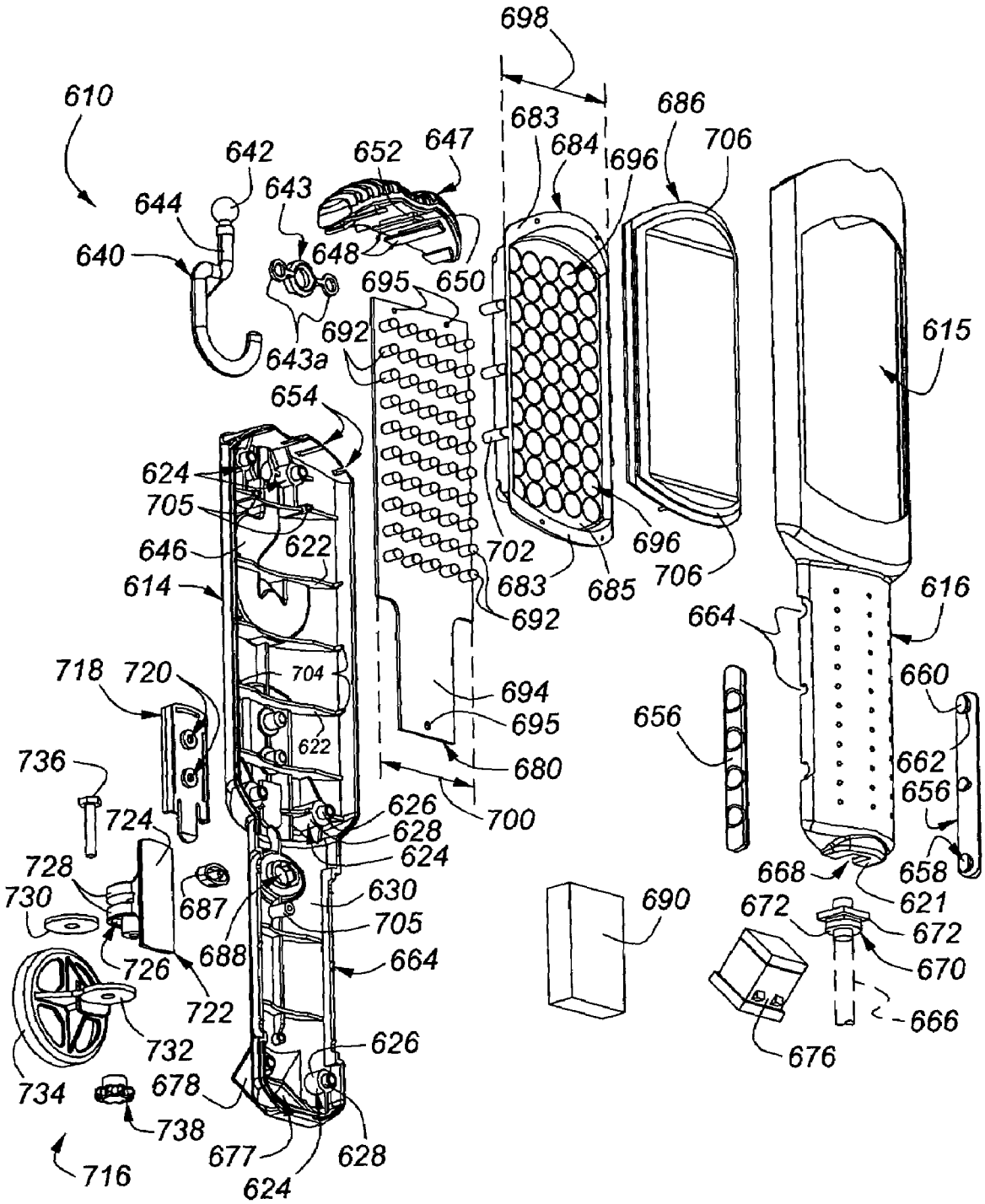
FIG. 3 is an exploded perspective view of the utility light of FIG. 1.
Figure 4:
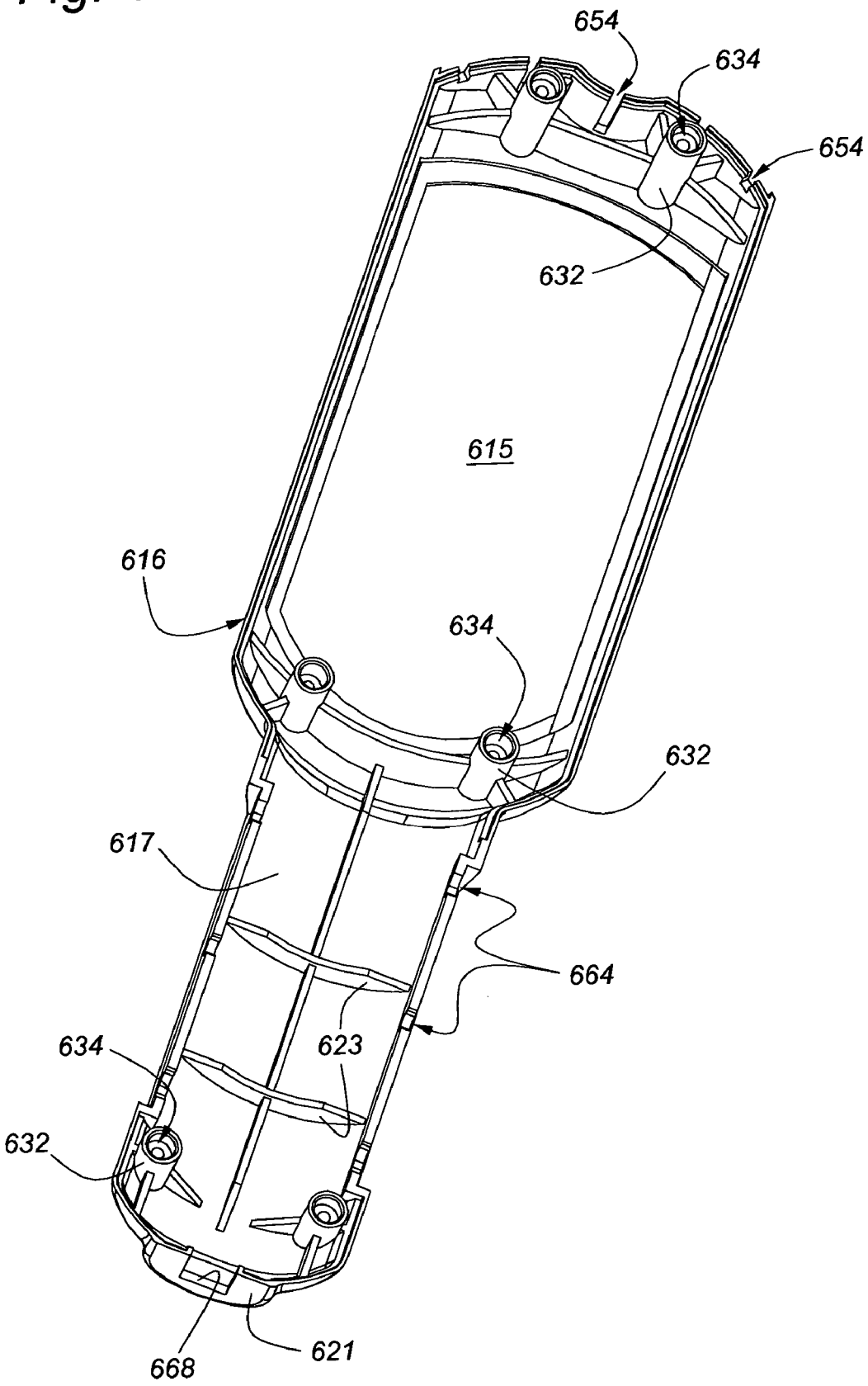
FIG. 4 is a perspective view of the interior of the front housing portion of the utility light shown in FIG. 1.

A power cord, shown in FIGS. 2 and 3 in phantom at 666, extends through an aperture 668 in a bottom wall 621 of the front housing portion 616 and is used to provide power to the circuitry, discussed below, that is enclosed within the housing 612. A strain relief 670 is adapted to be attached to the power cord 666. The strain relief 670 has a pair of spaced flanges 672 that retain an edge 674 (FIG. 5) of the bottom wall 621 defining the aperture 668 to retain the power cord 666 in place should a pulling force be applied to the power cord. The end of the power cord 666 has a male plug (not shown) for insertion into a common female electrical power receptacle (not shown) to obtain AC power. An electrical receptacle 676 is disposed in an aperture 677 formed in a projection 678 extending adjacent the bottom end of the front housing portion 616 at an angle canted with respect to a longitudinal axis of the light housing 612. An indicator 679 is disposed in an aperture formed in the exterior surface 636 of the rear housing portion 414 adjacent the plug 676 to visually indicate when the receptacle 676 is connected to a source of electrical power through the cord 666.

The hollow housing 612 defines a space between the rear portion 614 and the front portion 616 thereof for receiving a plurality of lighting components, including an LED circuit board assembly 680 having a switch 682 extending from a lower surface thereof a reflector member 684, and a lens member 686. The switch 682 is preferably a push button type that extends through an aperture 688 formed in the rear housing portion 614 of the handle portion 620 of the housing 612. The switch 682 electrically connects power from a power source 691 connected to the power cord 666 to an input of a conventional AC/DC power converter 690, best seen in FIG. 7. The converter 690 can be a separate unit mounted in the handle portion 620, or can be a circuit on the circuit board of the assembly 680. The LED circuit board assembly 680 includes a plurality of LEDs 692 extending from a front surface 694 thereof In the example shown, fifty LEDs 692 are arranged in an array having five columns and ten rows. The LEDs 692 are connected to an output of the converter 690 through the switch 682 and are operable to emit light in a well-known manner when a DC voltage is provided by the converter 690. The LED circuit board assembly 680 includes a plurality of alignment holes 695 extending through opposite ends thereof The alignment holes 695 engage with alignment pins 705 extending upwardly from outer edges of the support ribs 622 of the rear housing portion 614 and aid in the assembly of the utility light 610.

The reflector member 684 is in the form of a planar mask that fits over the front surface 694 of the LED circuit board assembly 680. The reflector member 684 includes a plurality of spaced apart apertures 696 formed therein. A front surface 685 of the reflector member 684 is preferably mirror chrome plated or has a similar highly reflective surface. The number and spacing of the apertures 696 corresponds to the number and spacing of the LEDs 692 on the circuit board assembly 680. The walls of the reflector member 684 that define each of the apertures 696 are also mirror chrome plated and taper radially outwardly toward the front surface 685 to form a generally cone-shape profile, best seen in FIGS. 3 and 4. A width, indicated by an arrow 698, of the reflector member 684 is greater than a width, indicated by an arrow 700, of the circuit board assembly 680. A plurality of spaced support legs 702 extend from a rear surface of the reflector member 684 along side edges thereof The spacing between the support legs 702 at opposed sides of the reflector member 684 is greater than the width 700 of the circuit board assembly 680 so that the support legs 702 extend beyond the side edges of the circuit board assembly 680 and engage with corresponding support pins 704 extending upwardly from outer edges of the support ribs 622 of the rear housing portion 614. A flange 683 extends from opposed upper and lower ends of the reflector member 684. The flange 683 has an upwardly extending portion 683*a* and an outwardly extending portion 683*b*, best seen in FIG. 5.

The lens member 686 is received in an aperture 615 extending through an upper portion of the front housing portion 616 during assembly of the utility light 610. The lens member 686 is preferably constructed of clear plastic material or similar material. The lens member 686 includes a flange 706 extending thereabout. The flange 706 includes a stepped portion 706*a*, best seen in FIG. 5. A flange 708 on the front housing portion 616 extends about the edges that define the aperture 615, best seen in FIG. 5, for retaining the stepped portion 706*a* upon assembly of the utility light 610.

Figure 6:
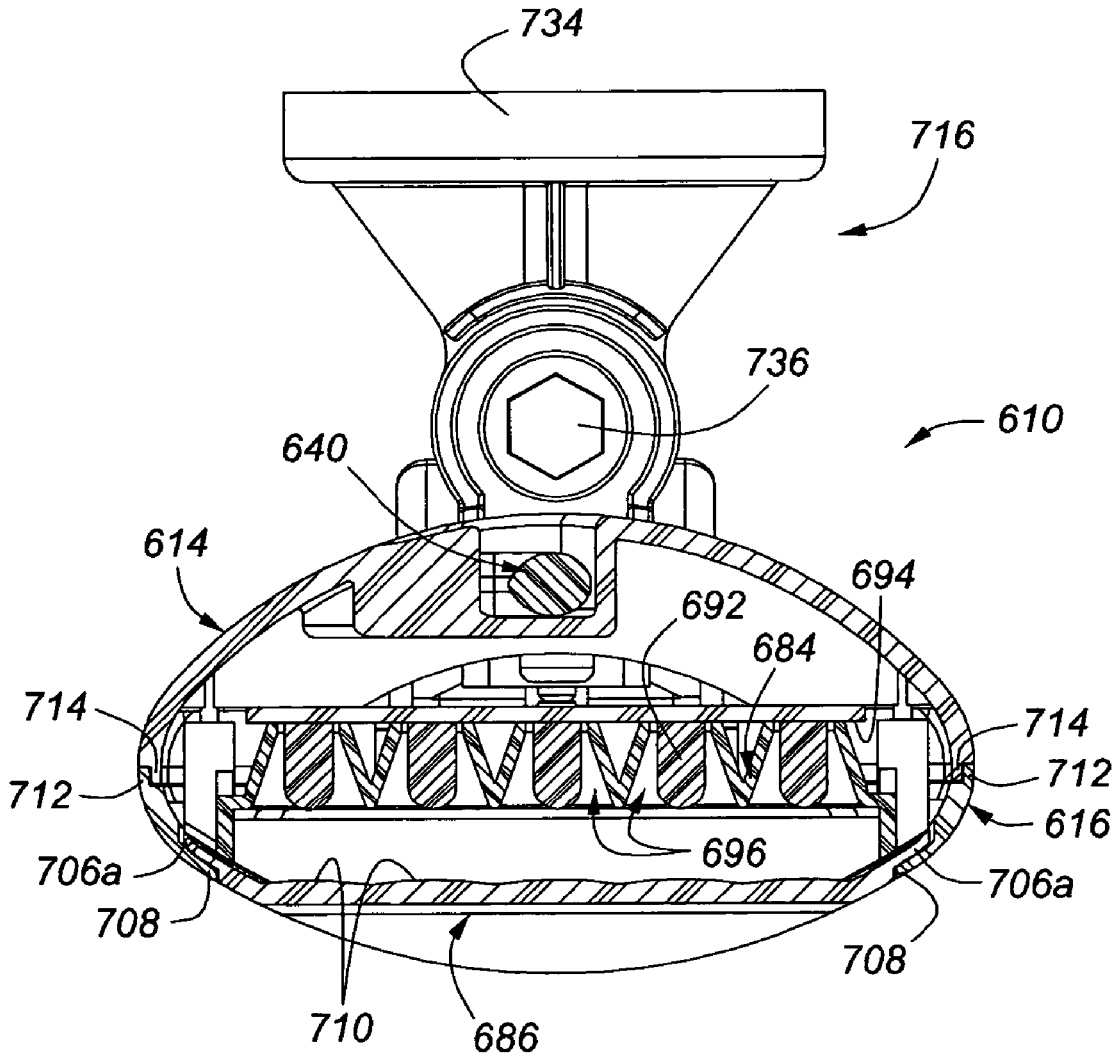
FIG. 6 is a cross-sectional view taken along line 6-6 in FIG. 2.

Referring to FIG. 6, the front housing portion 616 has a peripheral flange 712 on the outer edge that overlaps a cooperating peripheral flange 714 on the outer edge of the rear housing portion 614 when the portions 614 and 616 are secured together by the fasteners 633 extending through the bosses 624 engaged in corresponding posts 632.

Figure 5:
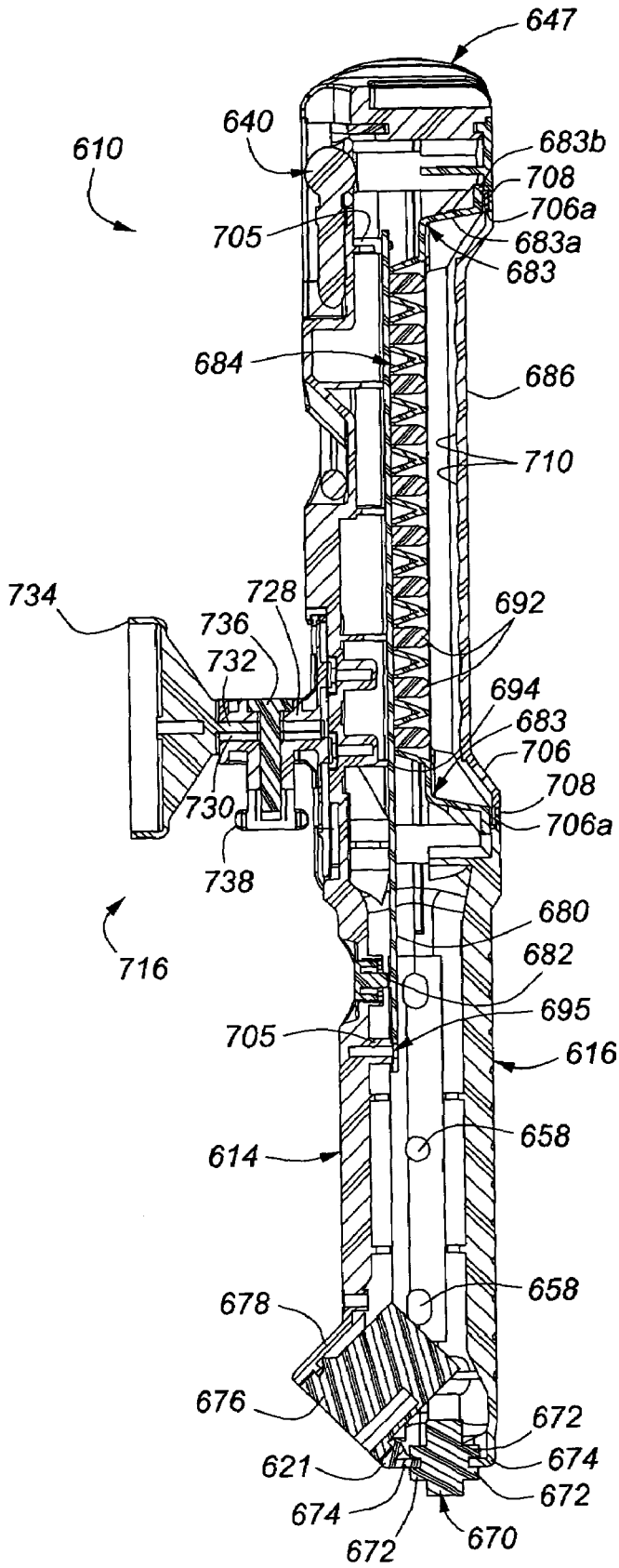
FIG. 5 is a cross-sectional view taken along line 5-5 in FIG. 1.

As seen in FIGS. 5 and 6, the lens member 686 has a plurality of focusing portions 710 that correspond in number and position to the LEDs 692. Each of the focusing portions 710 is formed as a convex protrusion on the rear surface of the lens member 686 facing the reflector member 684. The focusing portions 710 collect and focus light from the corresponding LEDs 692 to generate a collective focused beam of light exiting the lens member 686. However, the rear surface of the lens member 686 could be flat, so that no focusing is provided, or the areas adjacent the LEDs 692 could be formed with concave shapes, so that the light exiting the lens member 686 is dispersed for a flood light effect.

The switch 682 is easily actuated by a thumb or finger of a person (not shown) holding the handle portion 620 to light the LEDs 692 with one hand while also orienting and hanging the light 610 with the same hand. A flexible cover 687 can be provided on the switch 682 to protect it from dirt and liquids.

A magnet assembly 716 is adapted to be attached to the exterior surface 636 of the rear housing portion 614. The magnet assembly 716 includes a magnet slide bracket 718 that is attached to the rear housing portion by a fastener (not shown) extending through each aperture 720 (two are shown) formed in the slide bracket 718. A slide member 722 includes a base 724 and an adjustment bracket 726 extending therefrom The base 724 of the slide member 722 is adapted to be slidably disposed in a slot between spaced apart walls (not shown) on an outer surface of the slide bracket 718. The adjustment bracket 726 includes a pair of spaced apart flanges 728 each having an aperture extending therethrough. The flanges 728 of the adjustment bracket 726 receive therebetween a washer 730 and a magnet bracket 732 extending from a magnet 734. The washer 730 and the bracket 732 each include an aperture extending therethrough that receive, along with the apertures in the flanges 728, a fastener 736 that is secured to the magnet assembly 716 by a handwheel or knob 738. When the components of the magnet assembly 716 are attached to the utility light 610 and the magnet 734 is magnetically attached to a surface (not shown), the knob 738 allows the tension on the fastener 736 to be reduced and allows adjustment and orientation of the utility light 61 along an axis of rotation about the longitudinal axis of the fastener 736. The magnet assembly 716 may be easily removed from the utility light 610 by sliding the slide member 722 out of the slot on the slide bracket 718.

Figure 7:
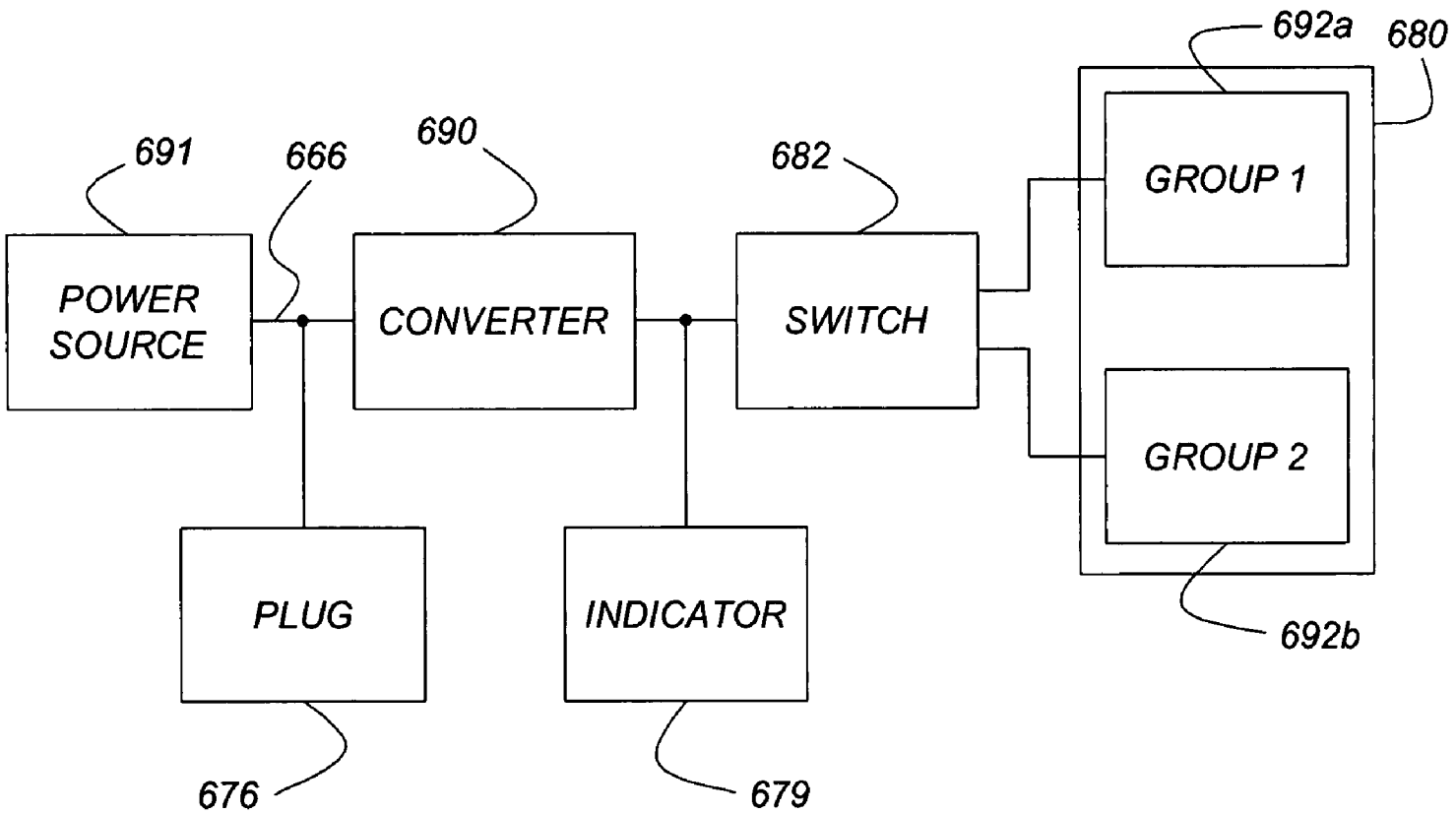
FIG. 7 is an electrical schematic of the utility light shown in FIG. 1.

An electrical schematic of the utility light 610 is shown in FIG. 7. The AC to DC converter 690 is provided for converting AC power from the power source 691, when the power cord 666 is connected to the power source 691, to the lower voltage DC power required to power the LEDs 696 of the LED circuit board assembly 680. When the power cord 666 is connected to the power source 691, the plug 676 is also energized, advantageously allowing the user of the utility light 610 to power, for example, additional electrical tools (not shown).

The electrical power from the converter 690 is directed through the switch 682 to the LED circuit board assembly 680. The switch 682 has at least a pair of "on" positions wherein in a first "on" position the switch 682 can direct electrical power from the converter 690 to a first or central group 692*a* of the LEDs 692 wherein only those LEDs in a central portion, for example, of the assembly 680 are lighted. In a second "on" position, the switch 682 directs power to light a second group 692*b* including all of the LEDs 692. The utility light 610 also includes the indicator 679 that, when the power cord 66 is connected to the power source 691 such that the converter 690 is energized, will indicate that the utility light 610 and the receptacle 676 are energized. The indicator 679 is preferably a red LED mounted in the aperture formed in the exterior surface 636 of the rear housing portion 614, best seen in FIG. 1.

The utility light 610 shown in FIGS. 1-6 has the LEDs 692 arranged in five columns of ten rows for a total of fifty LEDs. The center three columns can be the first group 692*a* such that sixty percent of the total light output is generated by thirty LEDs in the first "on" position of the switch 682. All of the columns are included in the second group 692*b* such that the total light output is generated by fifty LEDs in the second "on" position of the switch 682. An alternative array can consist of three columns and eight rows for a total of twenty-four LEDs. In that case, the center column can be the first group 692*a* and all the LEDs can be the second group 692*b*. The twenty-four LED array permits a smaller housing 612 since the circuit board assembly 680 will be smaller.

Of course, any number of LEDs can be used. For example, the patent application Ser. No. 10/915,527, incorporated herein by reference, shows an array of four columns and six rows (FIG. 2) for a total of twenty-four LEDs. The patent application Ser. No. 10/914,805, incorporated herein by reference, shows an array of three columns and ten rows (FIG. 2) for a total of thirty LEDs and an array of three columns and twenty rows (FIG. 6) for a total of sixty LEDs.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An LED utility light comprising;

a vertically and horizontally split hollow housing comprising an upper rear housing portion, a lower rear housing portion and a front portion extending the length of the upper and lower rear housing portions and having an upper light portion connected to a lower handle portion, said light portion having a lens opening formed therein, wherein said housing extends longitudinally along said vertical split and is oriented for use along said vertical split;

a plurality of LEDs mounted in said housing adjacent said lens opening;

a transparent lens member mounted in a vertical orientation to said vertically extending housing in said lens opening permitting light generated from said LEDs to exit said housing; and a rotatable magnet mounted on said housing and adapted to releasably retain the utility light on a support surface.

2. The light according to claim 1 including a magnet assembly having said magnet and a bracket attached to said magnet, said bracket permitting rotational movement of said magnet about an axis generally parallel to a longitudinal axis of said housing.

3. The light according to claim 2 including a fastener extending through said bracket and rotatably mounting said magnet on said housing.

4. The light according to claim 3 including a knob engaging said fastener for selectively preventing rotation of said magnet relative to said housing.

5. The light according to claim 1 including a magnet assembly having said magnet, a slide member attached to said magnet and a slide bracket attached to said housing, said slide member and said slide bracket cooperating to removably mount said magnet on said housing.

6. The light according to claim 1 including a magnet assembly having said magnet, a bracket attached to said magnet, a slide member, a fastener extending through said slide member and said bracket and rotatably mounting said magnet on said housing, and a slide bracket attached to said housing, said slide member and said slide bracket cooperating to removably mount said magnet on said housing.

7. The light according to claim 1 including an upper cushion formed of a resilient material and mounted on an upper end of said light portion of said housing.

8. The light according to claim 1 including at least one handle cushion mounted on said housing at said handle portion.

9. The light according to claim 1 including an electrical receptacle mounted in said housing adjacent a lower end of said handle portion.

10. The light according to claim 9 including an indicator light mounted in said housing and being electrically connected to said electrical receptacle for visually indicating when electrical power is available at said electrical receptacle.

11. The light according to claim 1 including a hook recess formed in said housing and a hook member attached to said housing for movement between a stored position in said hook recess and a use position out of said hook recess.

12. The utility light according to claim 1 wherein said LEDs are arranged in columns and rows.

13. The light according to claim 1 including a switch mounted on said housing and being connected to said LEDs, said switch having a first "on" for connecting a first group of said LEDs to a power source, said first group being less than all of said LEDs, and at least a second "on" position for connecting a second group of said LEDs to said power source, said second group including all of said LEDs not included in said first group.

14. An LED utility light comprising:

a vertically and horizontally split hollow housing comprising an upper rear housing portion, a lower rear housing portion and a front portion extending the length of the upper and lower rear housing portions and having an upper light portion connected to a lower handle portion, said light portion having a lens opening formed therein, wherein said housing extends longitudinally along said vertical split and is oriented for use along said vertical split;

a plurality of LEDs mounted in said housing adjacent said lens opening;

a transparent lens member mounted in a vertical orientation to said vertically extending housing in said lens opening permitting light generated from said LEDs to exit said housing; and a magnet assembly mounted on said housing and including a magnet adapted to releasably retain the utility light on a support surface, said magnet assembly permitting said magnet to rotate about an axis generally parallel to a longitudinal axis of said housing.

15. The light according to claim 14 wherein said magnet assembly includes a magnet bracket attached to said magnet, an adjustment bracket attached to said housing and a fastener rotatably attaching said magnet bracket to said adjustment bracket.

16. The light according to claim 15 including a knob engaging said fastener for selectively preventing rotation of said magnet relative to said housing.

17. The light according to claim 14 wherein said magnet assembly includes a slide member attached to said magnet and a slide bracket attached to said housing, said slide member and said slide bracket cooperating to removably mount said magnet on said housing.

18. An LED utility light comprising:

a vertically and horizontally split hollow housing comprising an upper rear housing portion, a lower rear housing portion and a front portion extending the length of the upper and lower rear housing portions and having an upper light portion connected to a lower handle portion, said light portion having a lens opening formed therein, wherein said housing extends longitudinally along said vertical split and is oriented for use along said vertical split;

an array of a plurality of LEDs mounted in said housing adjacent said lens opening;

a transparent lens member mounted in a vertical orientation to said vertically extending housing in said lens opening permitting light generated from said LEDs to exit said housing;

a reflector member mounted between said LED array and said lens member, said reflector member having a plurality of apertures formed therein, each said aperture receiving one of said LEDs;

a magnet assembly mounted on said housing and including a magnet adapted to releasably retain the utility, light on a support surface, said magnet assembly permitting said magnet to rotate about an axis generally parallel to a longitudinal axis of said housing.

19. The light according to claim 18 including an upper cushion formed of a resilient material and mounted on an upper end of said light portion of said housing.

20. The light according to claim 18 including at least one handle cushion mounted on said housing at said handle portion.

* * * * *